United States Patent [19]

Patton et al.

[11] 4,131,227

[45] Dec. 26, 1978

[54] CARRYING AND STORAGE CASE

[75] Inventors: Donna J. Patton, Chicago; Robert G. Riess, Park Ridge, both of Ill.

[73] Assignee: Bell & Howell Company, Chicago, Ill.

[21] Appl. No.: 789,475

[22] Filed: Apr. 21, 1977

[51] Int. Cl.[2] ..... B65D 79/00

[52] U.S. Cl. ..... 229/8; 46/1 L; 46/21; 206/457; 229/27; 229/52 B

[58] Field of Search ..... 46/1 L, 19, 21; 206/163, 164, 165, 166, 188, 198, 457; 229/8, 52 B, 27

[56] References Cited

U.S. PATENT DOCUMENTS

| | | | |
|---|---|---|---|
| D. 92,683 | 7/1934 | Strouse | 229/8 |
| 1,667,180 | 4/1928 | Willson | 229/8 |
| 1,715,583 | 6/1929 | Warren | 229/8 |
| 1,899,241 | 2/1933 | Marr | 229/8 |
| 2,019,231 | 10/1935 | Mallgraf | 46/21 |
| 2,020,196 | 11/1935 | Mallgraf | 46/21 |
| 2,337,931 | 12/1943 | Rode, Jr. | 229/8 |
| 2,413,315 | 12/1946 | Darragh et al. | 206/166 |
| 2,636,313 | 4/1953 | Shank | 229/8 |
| 2,723,488 | 11/1955 | Ringler | 206/457 |
| 2,755,963 | 7/1956 | Ringler | 206/198 |
| 3,044,211 | 7/1962 | Palm | 229/8 |
| 3,335,938 | 8/1967 | Kramer | 229/8 |

*Primary Examiner*—William Price
*Assistant Examiner*—Bruce H. Bernstein
*Attorney, Agent, or Firm*—Stanley J. Tomsa; Robert J. Schneider; Roger M. Fitz-Gerald

[57] ABSTRACT

A carrying and storage case for audio visual teaching aids fabricated from three interlocking sheets of corrugated cardboard or the like spaced and folded to resemble a house. One of the cardboard sheets forms the outside structure of the house, including the walls, roof and floor, the second sheet forms a chimney for the house, and the third sheet serves as a carrying handle, dividing wall and reinforcing structure for the carrying case.

4 Claims, 9 Drawing Figures

50
200
12
14
14a
14b
16
18
20
22
24
26
52
54
56
58
60
62
64
70
72
74
76
78
80
82
84
86
88
90
92
94
96
98
100
102
104
106
108
110
116
118
146
148
150
152
154
156
158
160
162
164
166
168
170
172
174
176
178
180
182
184
188
190
192
194
202
204
206
208
210
212
214
216
218
220
222
226
228
230

CARRYING AND STORAGE CASE

BACKGROUND OF THE INVENTION

This invention relates generally to carrying and storage cases, and more particularly, to a carrying and storage case fabricated from relatively inexpensive material, such as cardboard or the like, that is quite strong and rugged and yet is relatively simple and inexpensive to manufacture.

When audio visual aids are used in the classroom, it is desirable to provide a case for storing and transporting the instructional material. Preferably, such a case should be relatively rugged, since it is designed for classroom use, and relatively inexpensive. In addition, the case should be designed to make it interesting to grade school children.

SUMMARY OF THE INVENTION

It is an object of the present invention to provide an improved carrying and storage case.

It is another object of the present invention to provide a storage and carrying case unable for storing and carrying audio visual teaching materials.

Another object of the present invention is to provide a relatively low cost carrying case that is strong and rugged, and yet relatively simple and inexpensive to manufacture.

Another object of the invention is to provide a storage and carrying case that is visually interesting to children.

In accordance with a preferred embodiment of the invention, the carrying case is fabricated from three sheets of relatively rigid stock, such as corrugated cardboard or the like. A first sheet is cut and folded to form the four walls, bottom and top of the carrying case. The sheet is shaped so that two opposing walls are pentagonally shaped to resemble a house having a peaked roof, and one end of the sheet is folded over the pentagonally shaped wall to form the roof structure.

A second sheet is folded into an elongated rectangularly shaped cylinder having a top and a bottom, and designed to resemble a chimney. The rectangularly shaped cylinder extends through an aperture formed in the roof and serves as a separate storage compartment within the carrying case. A portion of the second sheet extends past the top of the cylinder and serves as a cover for the second storage compartment.

A third sheet of cardboard is shaped and folded to provide a dividing wall within the space surrounded by the first sheet and includes a handle portion extending through a slot in the portion of the first sheet forming the roof to permit the case to be readily carried in one hand. Other portions of the third sheet extend from the dividing wall, along the floor portion of the first sheet and upwardly along two of the sidewalls to provide reinforcement for the carrying case.

These and other advantages of the present invention will be more readily understood with reference to the following detailed description and attached drawing, wherein.

DETAILED DESCRIPTION OF THE INVENTION

Figure 1:
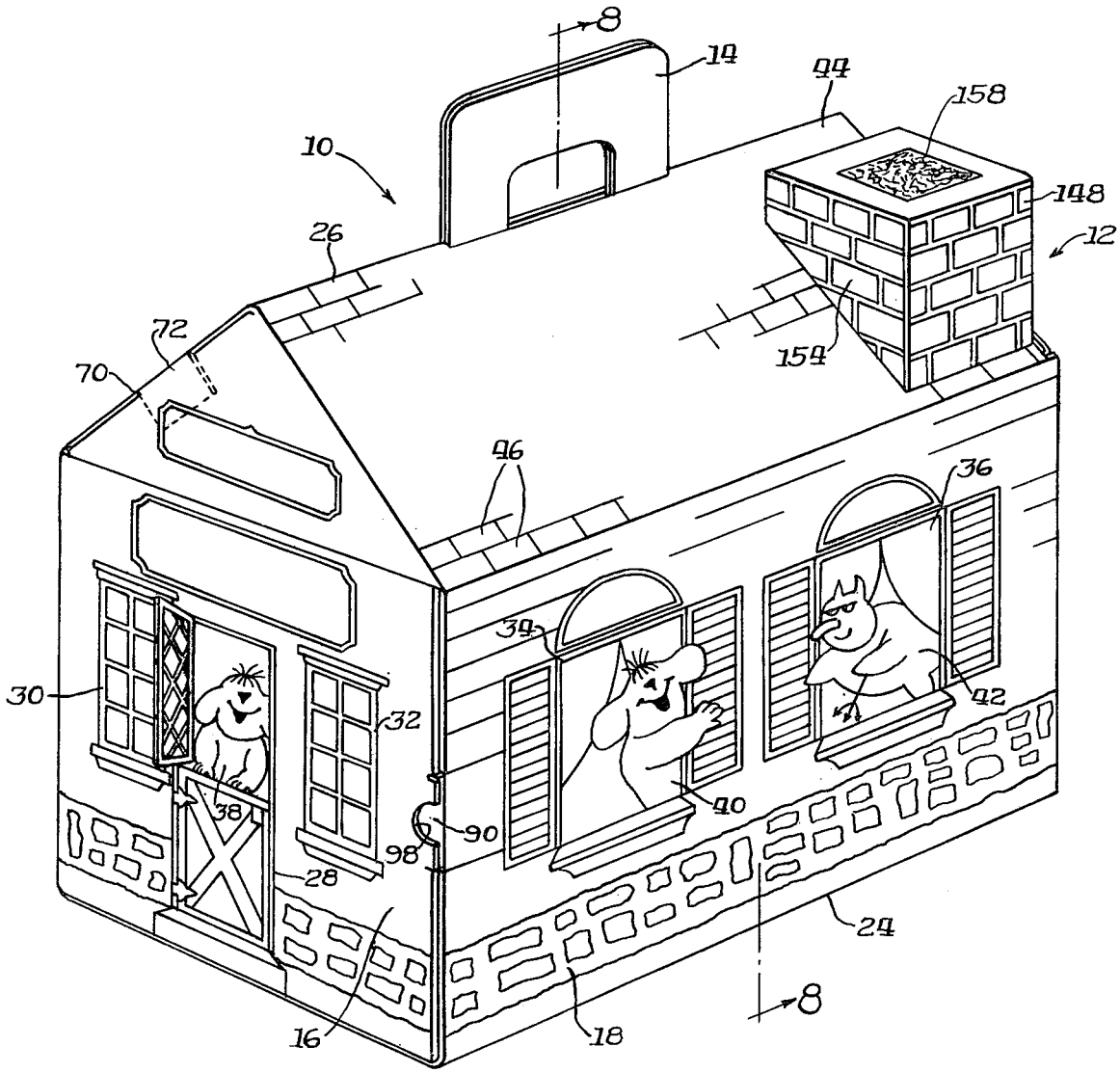
FIG. 1 is a perspective view of the carrying case according to the invention.
Figures 5, 6, 7:
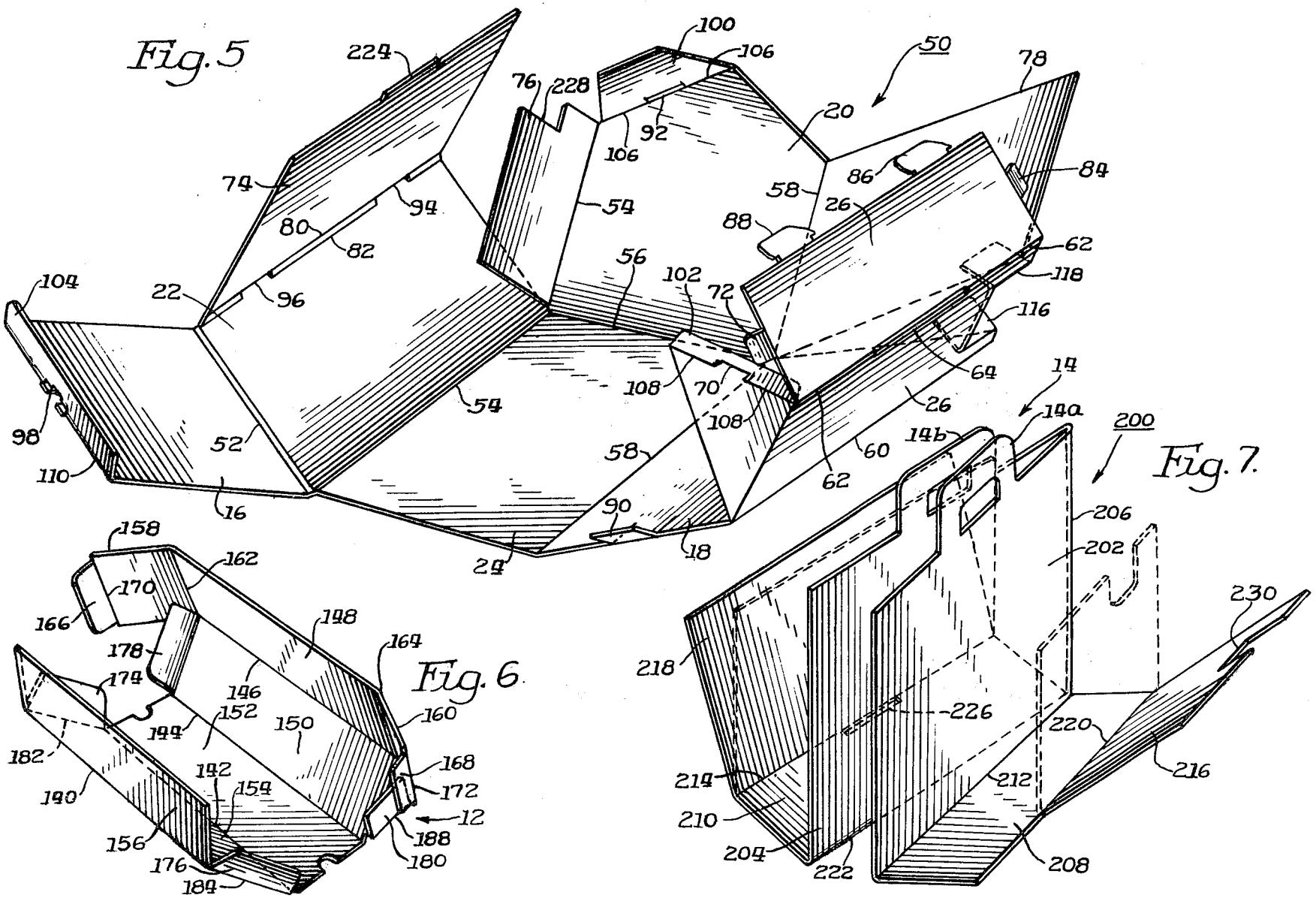
FIGS. 5, 6 and 7 are perspective views of the sheets shown in FIGS. 2, 3 and 4, respectively, shown in a partially folded condition.

Referring now to the drawing, with particular attention to FIG. 1, the carrying case, generally designated by the reference numeral 10, includes a chimney 12 and a carrying handle 14. The carrying case 10 defines a volume enclosed by four walls 16, 18, 20 and 22, a floor 24 and a roof 26 (FIGS. 1 and 5). Drawings of a doorway 28 and windows 30, 32, 34 and 36 are printed or otherwise applied to the walls 16 and 18, and similar doorways and windows may be applied to the walls 20 and 22 (not shown). Whimsical characters, such as dogs 38 and 40 and a devil 42, may be applied to the walls 16 and 18 to make the appearance of the carrying case more interesting to children of grade school age. Also, rectangles resembling bricks 44 are applied to the chimney 10 and other rectangles resembling shingles 46 are applied to the roof to increase the houselike character of the carrying case.

Figure 2:
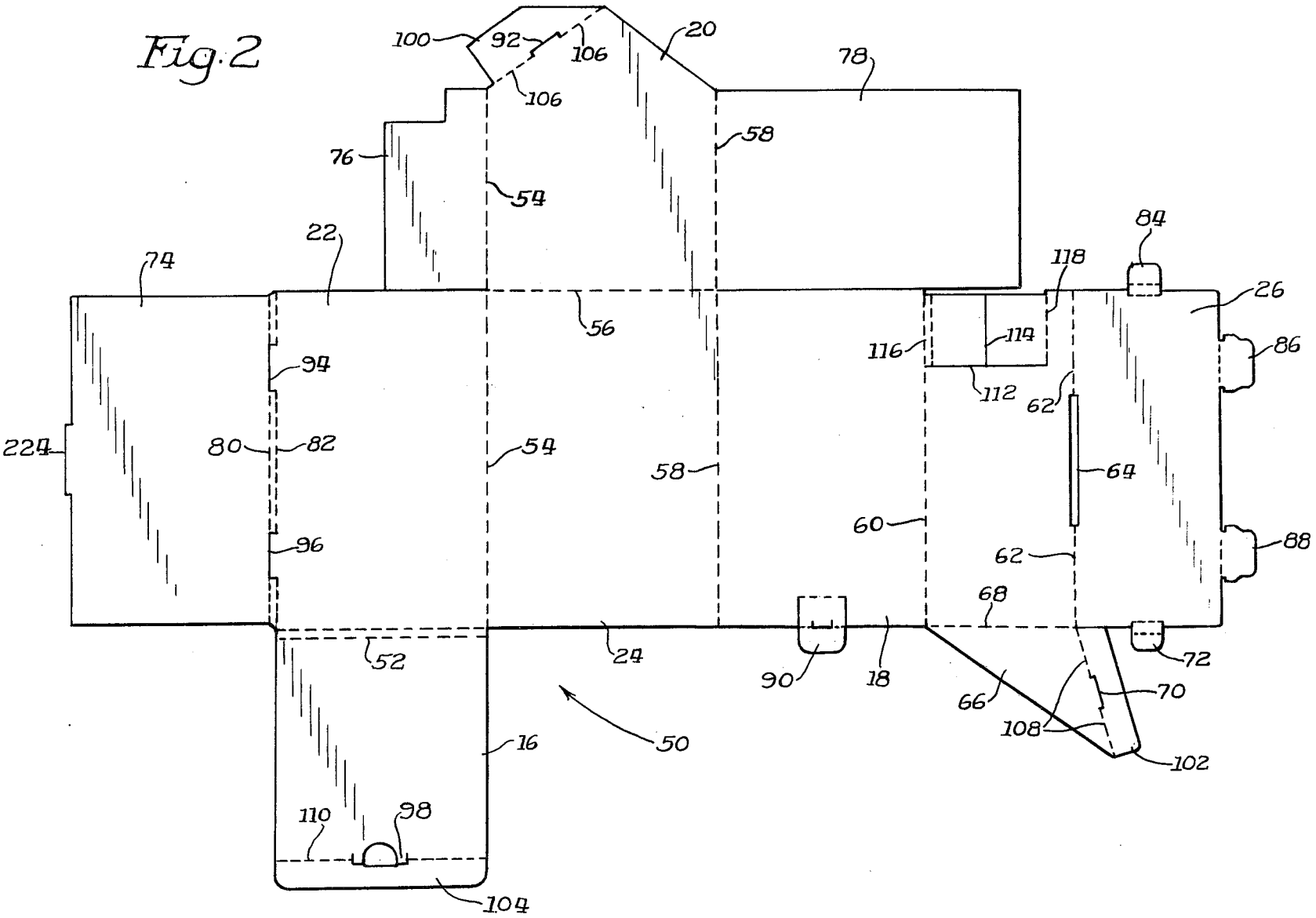
FIG. 2 is a plan view of a sheet of material forming the walls, floor and roof of the carrying case, shown in an unfolded condition.

The walls 16, 18, 20 and 22, the roof 26 and the floor 24 of the carrying case are formed from a single sheet 50 (FIG. 2) of rigid material, such as corrugated cardboard or the like. The shape of the sheet 50 is illustrated in FIG. 2 and includes the walls 16, 18, 20 and 22, the floor 24 and the roof 26 separated by fold lines 52, 54, 56, 58 and 60. The roof 26 includes a fold line 62 at its apex and a slot 64 for receiving the handle 14. A triangularly shaped peak portion 66 extends from the roof 26. A fold line 68 permits the peak portion 66 to be pivoted 90° with respect to the roof 26 so that a slot 70 may be engaged by a tab 72 when the roof 26 is folded along the fold line 62 in order to maintain the roof folded in a peaked shape.

In addition to the walls, roof and floor previously described, the sheet 50 has a number of reinforcing panels 74, 76 and 78 attached to the walls 20 and 22 at the fold lines 54 and 58 and a pair of fold lines 80 and 82. These reinforcing panels serve to reinforce the walls 18 and 22 when the sheet 50 is in a folded configuration. In addition, a plurality of tabs 84, 86, 88 and 90 engage a plurality of respective slots 92, 94, 96 and 98 to maintain the sheet 50 in a folded configuration. A plurality of lips 100, 102 and 104 extend from the wall 20, the peak 66 and the wall 16 along fold lines 106, 108 and 110 to permit the slots 92, 70 and 98 to be formed. The sheet 50 is also cut along lines 112 and 114, and folded along lines 60, 116 and 118 to provide an aperture in the roof 26 for the chimney 12.

Figure 3:
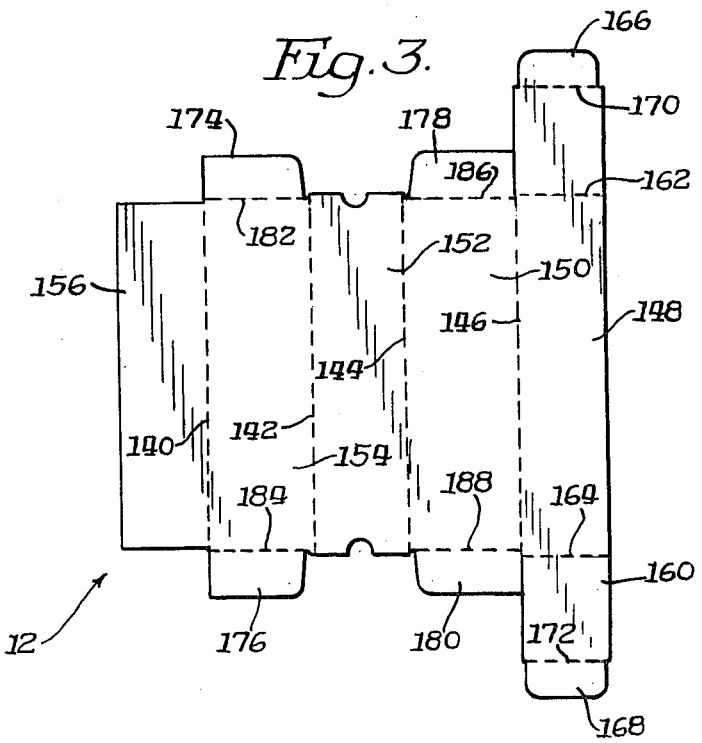
FIG. 3 is a plan view of a second sheet of material forming the chimney of the carrying case, shown in an unfolded condition.

The chimney 12 is fabricated from a second sheet of rigid material, similar to the material forming the sheet 50. As can be seen from FIG. 3, the sheet forming the chimney 12 is folded along four fold lines 140, 142, 144 and 146 to form four sides 148, 150, 152 and 154 of the chimney 12 and a reinforcing panel 156. In addition, a pair of panels 158 and 160 extend from opposite ends of the panel 148 to form a top and a bottom for the chimney 12 when folded along fold lines 162 and 164. A pair of lips 166 and 168 extend from the panels 158 and 160 and are folded along fold lines 170 and 172. The lips 166 and 168 engage the panel 152 when the chimney 12 is in a folded condition. Lips 174, 176, 178 and 180 are folded along fold lines 182, 184, 186 and 188, respectively, and serve to support the panels 158 and 160, respectively, when in a folded condition.

Figure 4:
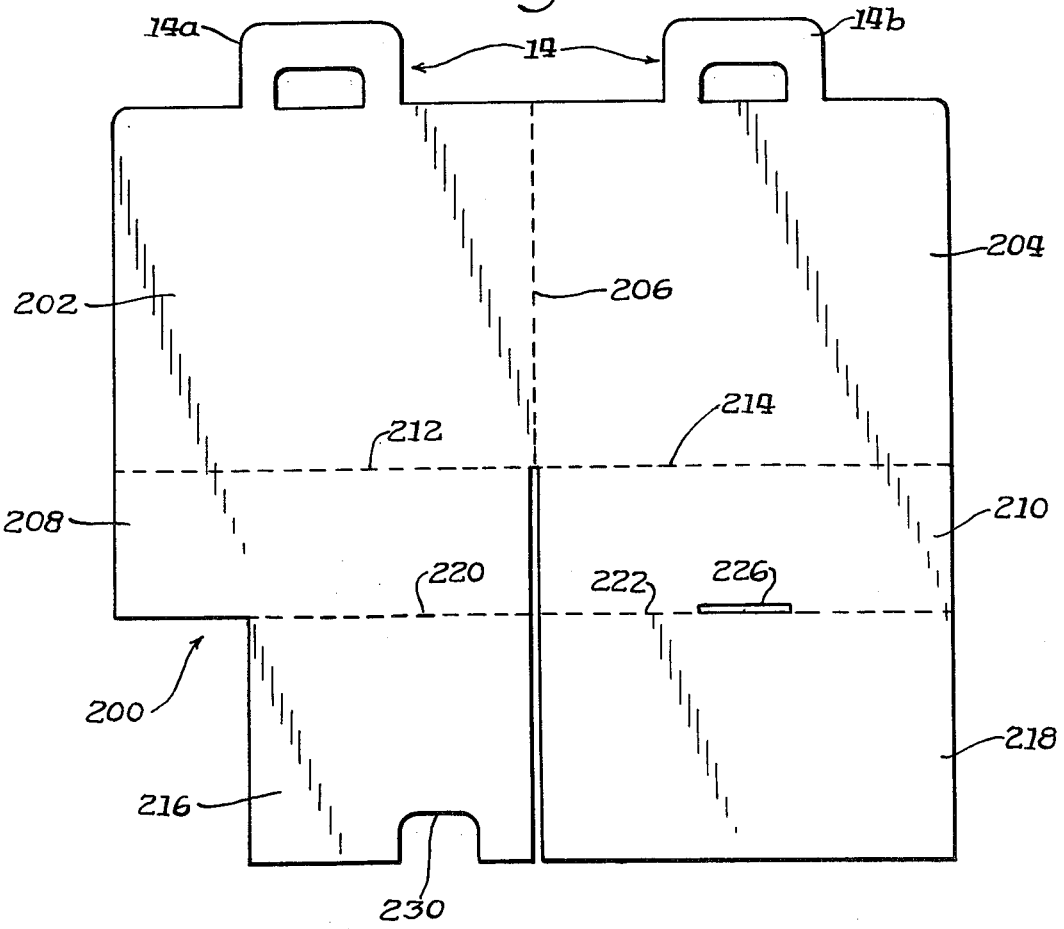
FIG. 4 is a plan view of a third sheet of material, shown in an unfolded condition, forming a dividing wall and carrying handle for the carrying case.

A third sheet 200 of rigid material similar to the material forming the sheet 50 and the chimney 12, is shown in FIG. 4. Two handle members 14*a* and 14*b* extending from the sheet 200 form the handle 14. Two panels 202 and 204 form a dividing wall for the volume defined by the folded sheet 50 when folded along a fold line 206. A second pair of panels 208 and 210 form a bottom reinforcing panel when folded along a pair of fold lines 212 and 214. A pair of panels 216 and 218 serve to reinforce the respective walls 22 and 18, and to maintain the sheet 200 in place within the carrying case 10. The panels 216 and 218 are folded along a pair of fold lines 220 and 222.

Figure 9:
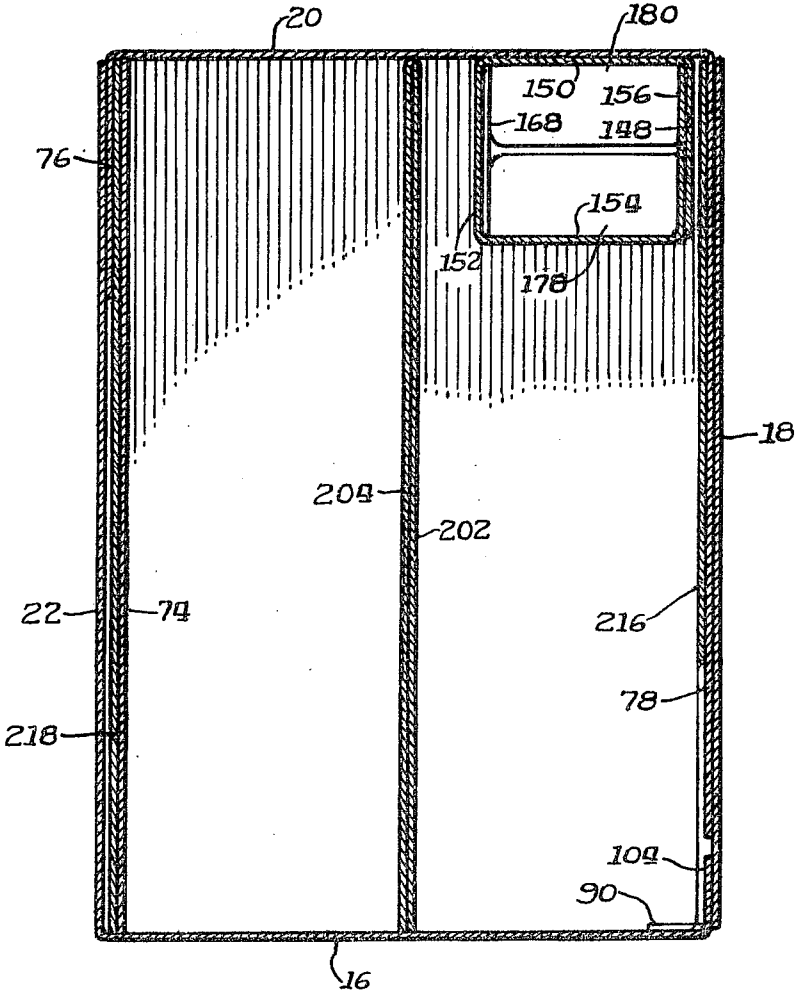
FIG. 9 is a top sectional view of the completely folded carrying case taken along line 9—9 of FIG. 8.
Figure 8:
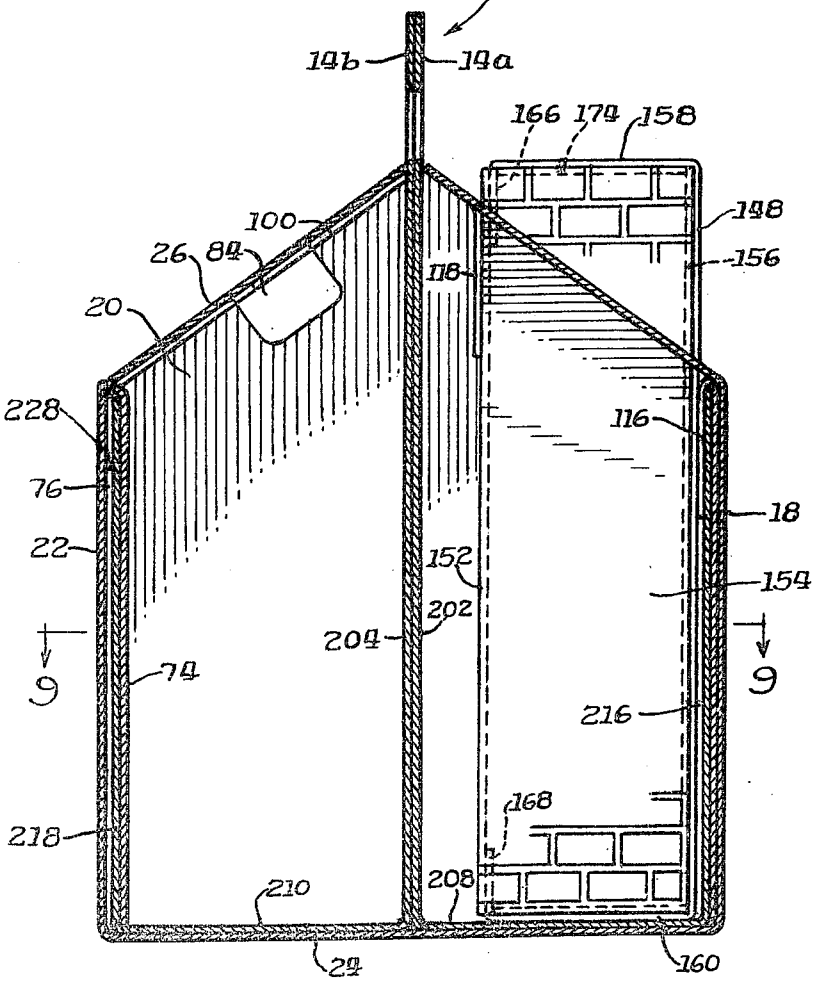
FIG. 8 is a sectional end view of the carrying case shown in a completely folded condition taken along line 8—8 of FIG. 1.

The manner in which the carrying case according to the invention is assembled is illustrated in FIGS. 5, 6 and 7. The case is shown completely assembled in FIGS. 8 and 9. The first sheet 50 is folded along the various fold lines, as shown in FIG. 5, and the third sheet 200 is folded as shown in FIG. 7. The folded sheet 200 is then placed on the first sheet 50 with the floor reinforcing panels 208 and 210 adjacent to the floor 24 (FIGS. 8 and 9). The wall reinforcing panels 216 are placed adjacent to the wall 22, and the panel 218 is placed adjacent to the wall 18. The first sheet is then folded along fold lines 54 and 56 to bring the panels 76 adjacent to the wall 22. Similarly, the sheet 50 is folded along the fold line 58 to bring the panel 78 adjacent to the panel 218. The first sheet is then folded along the fold lines 80 and 82 to bring the panel 74 adjacent to the panels 76 and 216, thereby retaining the sheet 200 in place by means of the panels 74 and 78. A tab 224 extending from the panel 74 engages a slot 226 in the sheet 200 to maintain the sheet 50 in a folded position along the fold lines 80 and 82.

The roof 26 is folded along the fold line 74 to bring the tab 72 into engagement with the slot 70. The roof 26 is also folded along the fold line 60 to bring the tabs 86 and 88 into engagement with the slots 94 and 96 when the wall 22 is in an upright position. Notches 228 and 230 are formed in the panels 76 and 216, respectively, to permit the tabs 86 and 88 to pass between the wall 22 and the panel 74. Closure of the carrying case is completed by folding the first sheet 50 along the fold lines 52 and 110 to bring the tab 90 into engagement with the slot 98.

The chimney 12 is folded along the various fold lines to form a rectangular cylinder having the panel 156 adjacent to the side 148 (FIG. 6). The lips 176 and 180 are folded perpendicularly to the respective walls 154 and 150. The bottom panel 160 and lip 168 are folded as shown to bring the lip 168 into contact with the wall 152 to close the bottom portion of the chimney 12. The top portion of the chimney 12 is closed in a similar manner by appropriately folding the panel 158 and the lips 166, 174 and 178. The roof 26 is folded downwardly at the fold lines 116 and 118 (FIG. 5), and the assembled chimney 12 is inserted into the aperture formed by the downwardly bent portions extending from the fold lines 116 and 118 (FIGS. 8 and 9). This forms the chimney effect as shown in FIG. 1.

Thus, a three compartment carrying case has been formed. The chimney 12 forms a compartment suitable for relatively small items, such as erasers, pencils, labels or the like. The sheet 50 encloses two larger compartments separated by the sheet 200. These larger compartments are useful for storing larger items such as tablets of paper, flash cards and audio visual teaching aids.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A carrying case shaped to resemble a house having four walls, a roof and a floor, comprising:

a first sheet of rigid stock shaped and folded to form the four walls, floor and roof of the house, said roof having an aperture and a slot defined therein;

a second sheet of rigid stock interposed between two of said walls to form a dividing wall, said second sheet including a handle portion extending through the slot in said roof and forming a carrying handle for said case, said second sheet being folded onto itself to form two panels, said dividing wall being formed from said two panels to form a double thickness wall, one of said panels being folded and disposed adjacent to said floor on one side of said dividing wall and adjacent to the one of said walls opposite said one side of said dividing wall, the other one of said panels being folded and disposed adjacent to said floor on the other side of said dividing wall and adjacent to said wall opposite said other side of said dividing wall, said first sheet being folded over the portions of said first and second panels adjacent to said respective walls opposite said dividing wall, thereby retaining said portions of said first and second panels adjacent said walls opposite said dividing wall;

a third sheet of rigid stock shaped and folded to form a hollow rectangular cylinder having at least one movable end cover, said rectangular cylinder extending from within said case through the aperture in said roof to form a chimney and to define a separate, self-contained storage compartment within said defined case.

2. A carrying case as recited in claim 1 wherein said first sheet includes a plurality of slots defined therein and a plurality of interlocking tabs extending through said slots to maintain said sheet in a folded condition for defining the walls, roof and floor of said house.

3. A carrying case as recited in claim 2 wherein said first sheet includes a tab extending from said roof, said first sheet further including a slot for receiving said tab, and one of said panels includes a notch formed therein for receiving said tab between two folded sections of said first sheet.

4. A carrying case as recited in claim 2 wherein said roof is a peaked roof.

* * * * *

UNITED STATES PATENT OFFICE

CERTIFICATE OF CORRECTION

PATENT NO. : 4,131,227

DATED : December 26, 1978

INVENTOR(S) : Donna J. Patton and Robert G. Riess

It is certified that error appears in the above-identified patent and that said Letters Patent are hereby corrected as shown below:

Column 4, line 52, cancel beginning with "2. A carrying case" to and including "of said house." in column 4, line 56, and insert the following claim:

--2. A carrying case shaped to resemble a house having four walls, a roof and a floor, comprising:

a first sheet of rigid stock shaped and folded to form the four walls, floor and roof of the house, said roof having an aperture and a first slot defined therein;

a second sheet of rigid stock interposed between two of said walls to form a dividing wall, said second sheet including a handle portion extending through said first slot in said roof and forming a carrying handle for said case; and a third sheet of rigid stock shaped and folded to form a rectangular cylinder, said rectangular cylinder extending through the aperture in said roof to form a chimney;

said second sheet being folded onto itself to form two adjacent panels, each of said panels being folded and disposed adjacent the floor on both sides of the dividing wall and adjacent the walls opposite the sides of said dividing wall, at least one of said panels having a second slot therein; and

UNITED STATES PATENT OFFICE

CERTIFICATE OF CORRECTION

PATENT NO. : 4,131,227

DATED : December 26, 1978

INVENTOR(S) : Donna J. Patton and Robert G. Riess

It is certified that error appears in the above-identified patent and that said Letters Patent are hereby corrected as shown below:

said first sheet being folded over portions of said panels adjacent said respective walls and including a tab for engaging said second slot to retain said first sheet in a folded position over said panel.--

Signed and Sealed this

*Third* Day of *July 1979*

[SEAL]

*Attest:*

*Attesting Officer*

LUTRELLE F. PARKER

*Acting Commissioner of Patents and Trademarks*